US005634368A

United States Patent [19]

Venäläinen

[11] Patent Number: 5,634,368

[45] Date of Patent: Jun. 3, 1997

[54] DEVICE AND METHOD FOR ALIGNMENT OF AN AUTOMOBILE BODY

[75] Inventor: Teuvo O. Venäläinen, Kuopio, Finland

[73] Assignee: Autorobot Finland Oy, Kuopio, Finland

[21] Appl. No.: 526,416

[22] Filed: Sep. 11, 1995

[30] Foreign Application Priority Data

Dec. 9, 1994 [FI] Finland ..... 944210

[51] Int. Cl.[6] ..... B21J 13/08

[52] U.S. Cl. ..... 72/457; 72/705; 72/295; 72/305; 72/372

[58] Field of Search ..... 72/705, 293, 295, 72/372, 305, 457, 461; 269/45

[56] References Cited

U.S. PATENT DOCUMENTS

| | | | |
|---|---|---|---|
| 3,091,278 | 5/1963 | Padgett | 72/295 |
| 3,696,653 | 10/1972 | Mojelski | 72/293 |
| 4,337,636 | 7/1982 | Clausen | 72/457 |
| 4,344,314 | 8/1982 | Aldrich et al. | 72/705 |
| 4,400,969 | 8/1983 | Specktor | 72/705 |
| 4,516,423 | 5/1985 | Reich | 72/705 |
| 4,628,723 | 12/1986 | Buske | 72/705 |
| 5,186,039 | 2/1993 | Celette | 72/705 |

*Primary Examiner*—Lowell A. Larson
*Assistant Examiner*—Ed Tolan
*Attorney, Agent, or Firm*—Steinberg, Raskin & Davidson, P.C.

[57] ABSTRACT

A device for alignment of a vehicle body and a method in the work of alignment of a vehicle body. The device includes an alignment table to which the vehicle is attached by skirt clamps, the vehicle being fixed from skirt plates to the skirt clamps and through the skirt clamps to the alignment table during alignment work. Each skirt clamp has a support arm which is positionable in relation to, and separated from, the skirt clamp and which support arm can be coupled with the skirt clamp by a fastening member. The support arm is also connected with the constructions of the vehicle directly or through intermediate parts such that damage to the skirt beam is prevented by the support arm during the alignment work as the support force of the support arm is received by the skirt clamps.

21 Claims, 7 Drawing Sheets

FIG. 3A
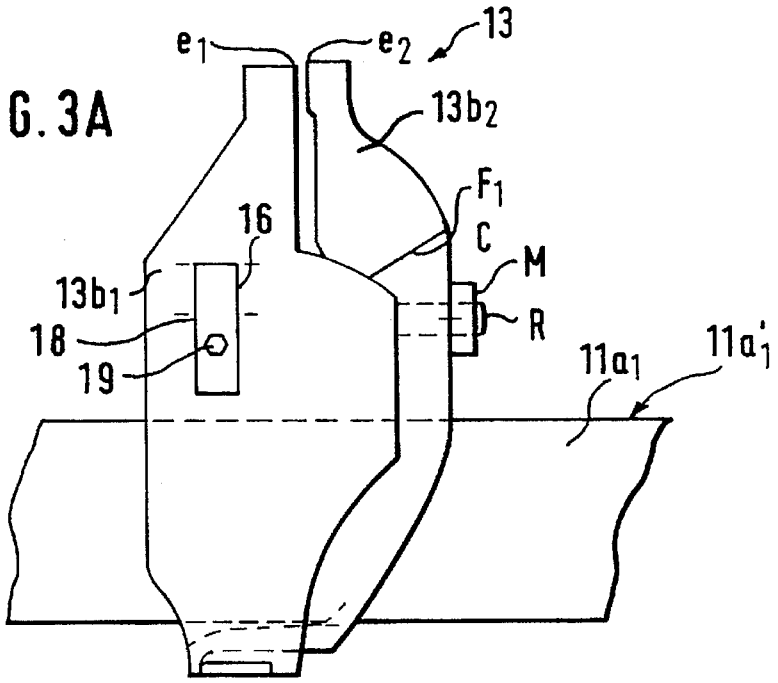
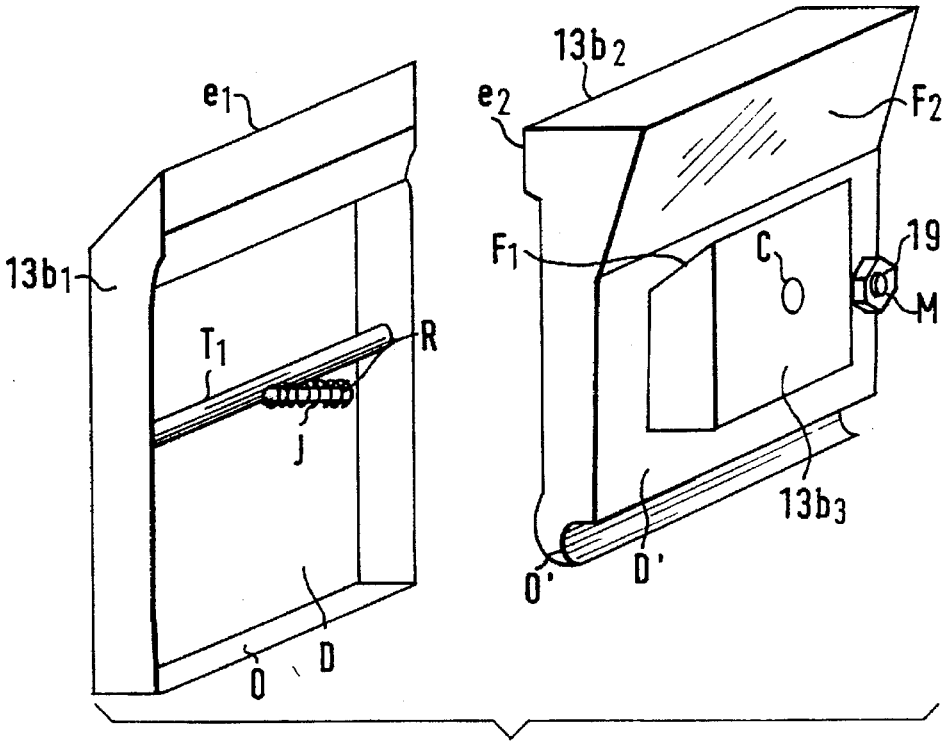
FIG. 3B

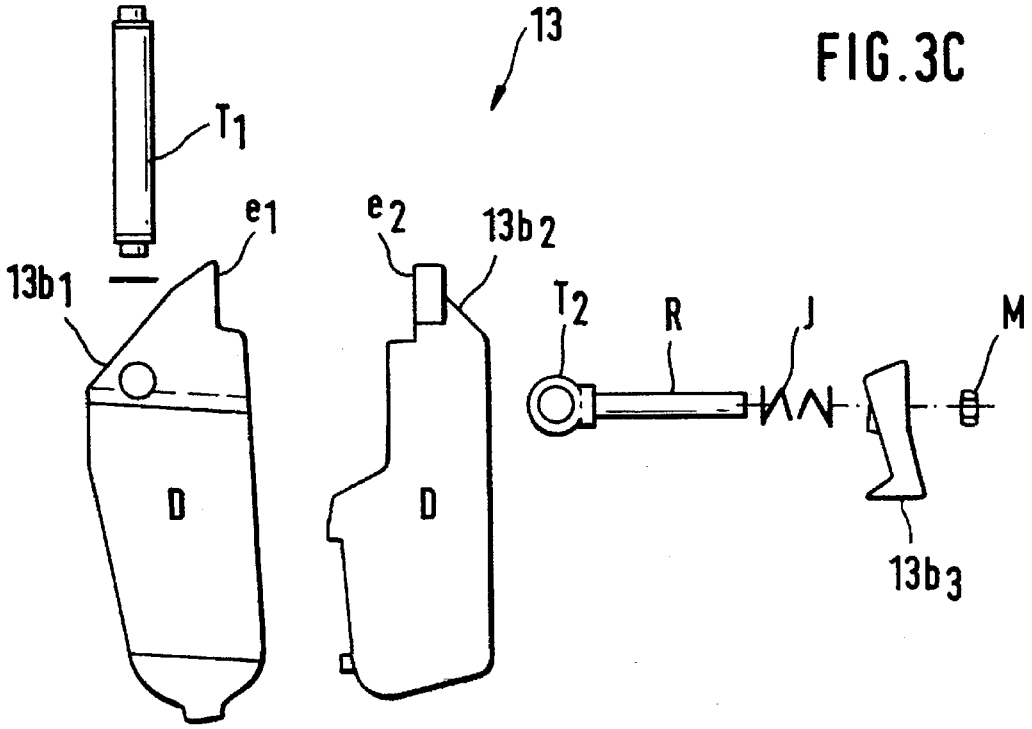
FIG.3C
FIG.4A
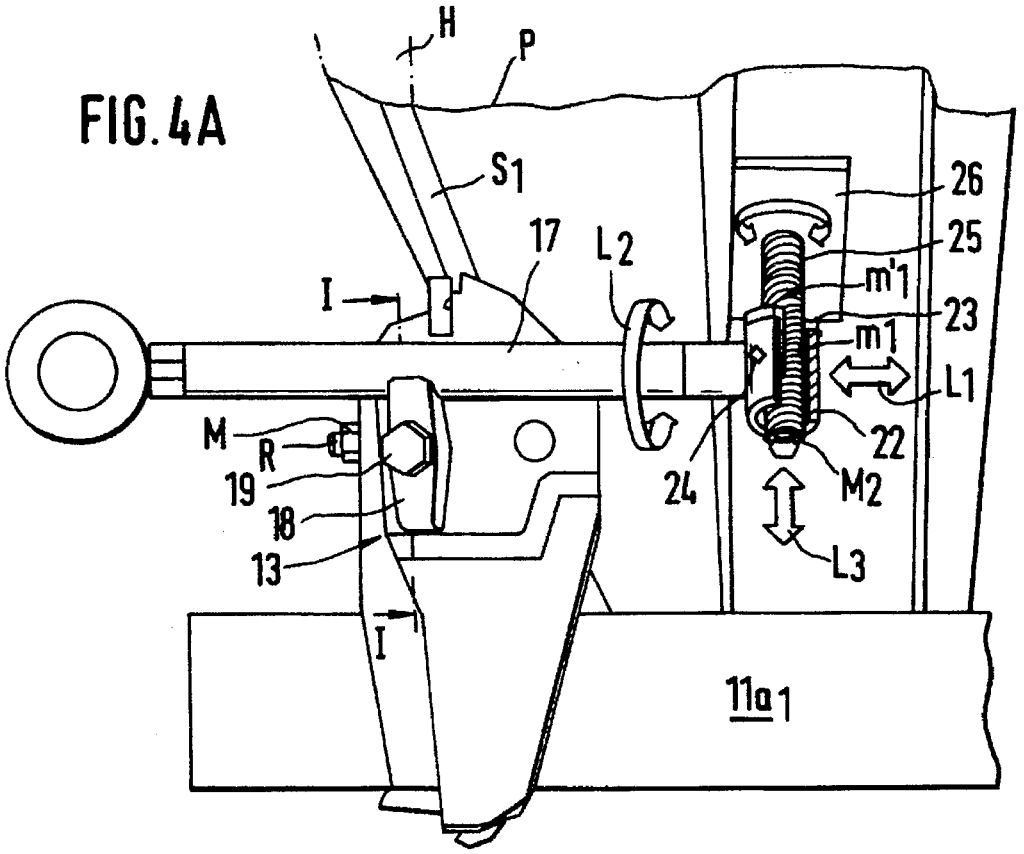

FIG. 6
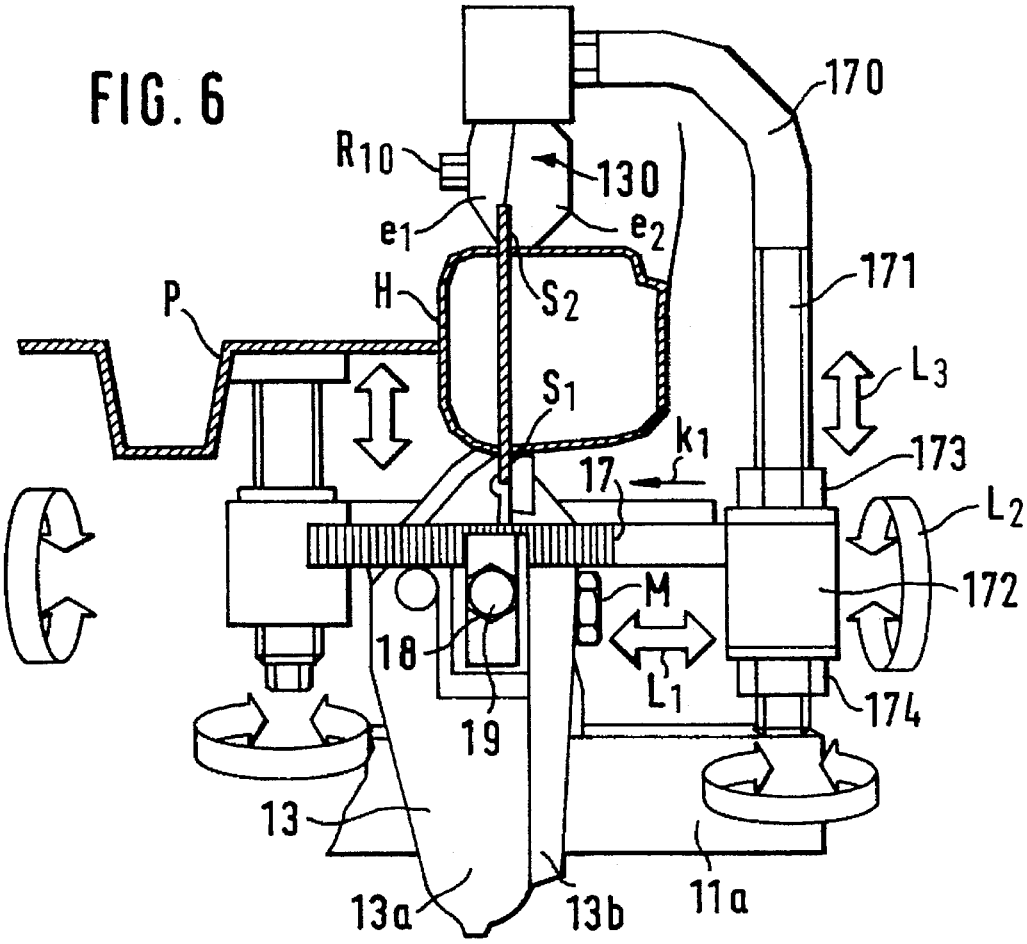
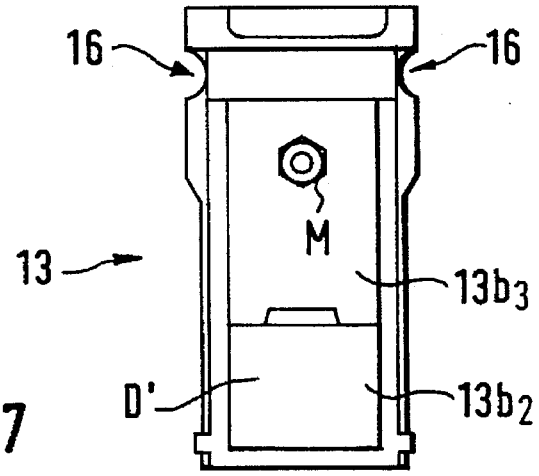
FIG. 7

DEVICE AND METHOD FOR ALIGNMENT OF AN AUTOMOBILE BODY

FIELD OF THE INVENTION

The invention relates to a device for alignment of an vehicle body and a method for the alignment of an vehicle body and particularly to a method and device for the alignment of an automobile body.

BACKGROUND OF THE INVENTION

In the prior art, devices for the alignment of an automobile body are known in which the vehicle is driven onto a so-called alignment table and fixed to skirt fastenings or skirt clamps connected with the alignment table. The skirt fastenings are pressed by their jaws against skirt plates, joints or beams of the vehicle, whereby the vehicle is then fastened by its skirt beams to the alignment table upon tightening of the jaws.

It is a particular problem of the mode of fastening of the vehicle to the alignment table in the conventional arrangement that the alignment forces when applied to the vehicle body, tend to buckle and bend the skirt beam because the support takes place from below, i.e., from only the joint placed at the bottom of the skirt beam.

OBJECTS AND SUMMARY OF THE INVENTION

It is an object of the present invention to provide a new and improved device and method for the alignment of an automobile body or other vehicle body in which the problem of the conventional arrangement is substantially avoided.

It is another object of the present invention to provide a new and improved device and method for the alignment of an automobile body or other vehicle body in which a single skirt clamp or skirt fastening is coupled to two different portions or support regions of the skirt beam of the vehicle, preferably the upper and lower joint of the skirt beam, in order to prevent or at least substantially lessen damage to the skirt beam during alignment work.

To achieve these objects, and others, in the device and method in accordance with the invention, the skirt clamp or fastening comprises, in addition to a usual support for the lower joint of the skirt beam via cooperating jaws, a separate support arrangement by whose means the vehicle can be supported either from an upper joint of the skirt beam or from another portion of the skirt beam in the vicinity of that portion which is grasped between the jaws. Thus, according to the invention, a separate support arm is provided which can be attached to the skirt clamp directly by means of a fastening device, preferably a screw.

Further, according to the present invention, a back-up face of circular section has been formed onto the skirt clamp or fastening. Against this back-up face, the support arm having a similar shape, i.e., a circular cross-section, can be placed while the back-up part presses the support arm against the body of the skirt clamp to thereby securely retain the same.

Briefly, the device in accordance with the invention comprises an alignment table and skirt clamps arranged on the alignment table for attaching skirt beams of the vehicle to the alignment table. Each skirt clamp comprises a first body part having a first jaw and a second body part having a second jaw, displacement means for moving the first and second jaws relative to one another to grasp a first support skirt beam of the vehicle. The device also includes a support arm, fastening means for detachably connecting the support arm to the first body part of the skirt clamp such that the support arm is movable relative to the skirt clamp, and coupling means for coupling the support arm to a second support region of the vehicle. Thus, in accordance with the invention, in addition to the grasping of the first support skirt beam of the vehicle by the jaws of the skirt clamp, and more particularly the lower joint of the skirt beam, the support arm couples the skirt clamp to a second support region of the vehicle, which may be proximate to the first support skirt beam of the vehicle body or the upper joint of the skirt beam.

The fastening means comprise a curved back-up recess arranged in the first body part, a back-up part having a curved recess arranged in connection with or in the direct vicinity of the curved back-up recess, and pressing means for pressing the back-up part against the support arm while the support arm is in a position between the curved back-up recess and the curved recess of the back-up part. The curved back-up recess and the curved recess of the back-up part have a shape corresponding to the shape of the support arm.

In one embodiment, the support arm is elongate and comprises a bushing at one end thereof having an internal threading. A rotatable screw is threaded into the internal threading of the bushing such that the screw is positionable in different positions relative to the bushing upon rotation thereof. Alternatively, a hollow bushing may be arranged at one end of the support arm, an auxiliary bushing being arranged in and fixedly coupled to the hollow bushing, the auxiliary bushing having an internal threading. A rotatable screw is then threaded into the internal threading of the auxiliary bushing such that the screw is positionable in different positions relative to the auxiliary bushing and the hollow bushing upon rotation thereof.

In another embodiment, the support arm comprises a member detachably coupled to one of the body parts and having a hollow interior and an internal threading. A rotatable screw is arranged in the hollow interior of the member in engagement with the internal threading. The screw is movable upon rotation thereof relative to the member. Locking means, e.g., a nut, are provided for locking the screw in a fixed position relative to the member.

In yet another embodiment, an elongate bushing is arranged at an end of the support arm and has a hollow interior and a nut arranged at each end thereof. An auxiliary support arm is coupled to and movable relative to the support arm. The auxiliary support arm comprises a threading engaging with the nuts and passing through the bushing such that the auxiliary support arm is movable relative to the support arm upon rotation of the threading of the auxiliary support arm relative to the bushing and the nuts. The auxiliary support arm also includes a clamp having jaws for engaging with a support region of the vehicle, e.g., the upper joint of the skirt beam.

In the method for supporting a vehicle body during alignment of the vehicle body on an alignment table, the lower joint of a skirt beam is grasped by means of first skirt clamps coupled to the alignment table, the upper joint of the skirt beam is grasped by means of second skirt clamps, and each of the second skirt clamps is coupled to a respective one of the first skirt clamps, e.g., by means of at least one support arm. As such, the support of the second clamp is transferred through the support arm(s) directly to a body on which the first clamp is situated.

The invention will be described in the following with reference to some preferred embodiments of the invention illustrated in the figures in the accompanying drawings. However, the invention is not confined to the illustrated embodiments alone.

BRIEF DESCRIPTION OF THE DRAWINGS

The following drawings are illustrative of embodiments of the invention and are not meant to limit the scope of the invention as encompassed by the claims.

FIG. 3A is a side view of a skirt clamp used in the method and device in accordance with the invention.

FIG. 3B is an exploded view of the parts of the skirt clamp shown in FIG. 3A.

FIG. 3C is a side view of the set of parts shown in FIG. 3B.

FIG. 4A shows a skirt clamp used in the device and method in accordance with the invention arranged in connection with a vehicle.

FIG. 6 shows another embodiment of the support in accordance with the invention, wherein the skirt beam of the vehicle is supported from below and above while the support point of the upper support is placed in the lower skirt clamp.

FIG. 7 shows the skirt clamp of FIG. 6 viewed in the direction of the arrow k1.

DETAILED DESCRIPTION OF THE INVENTION

Figure 1:
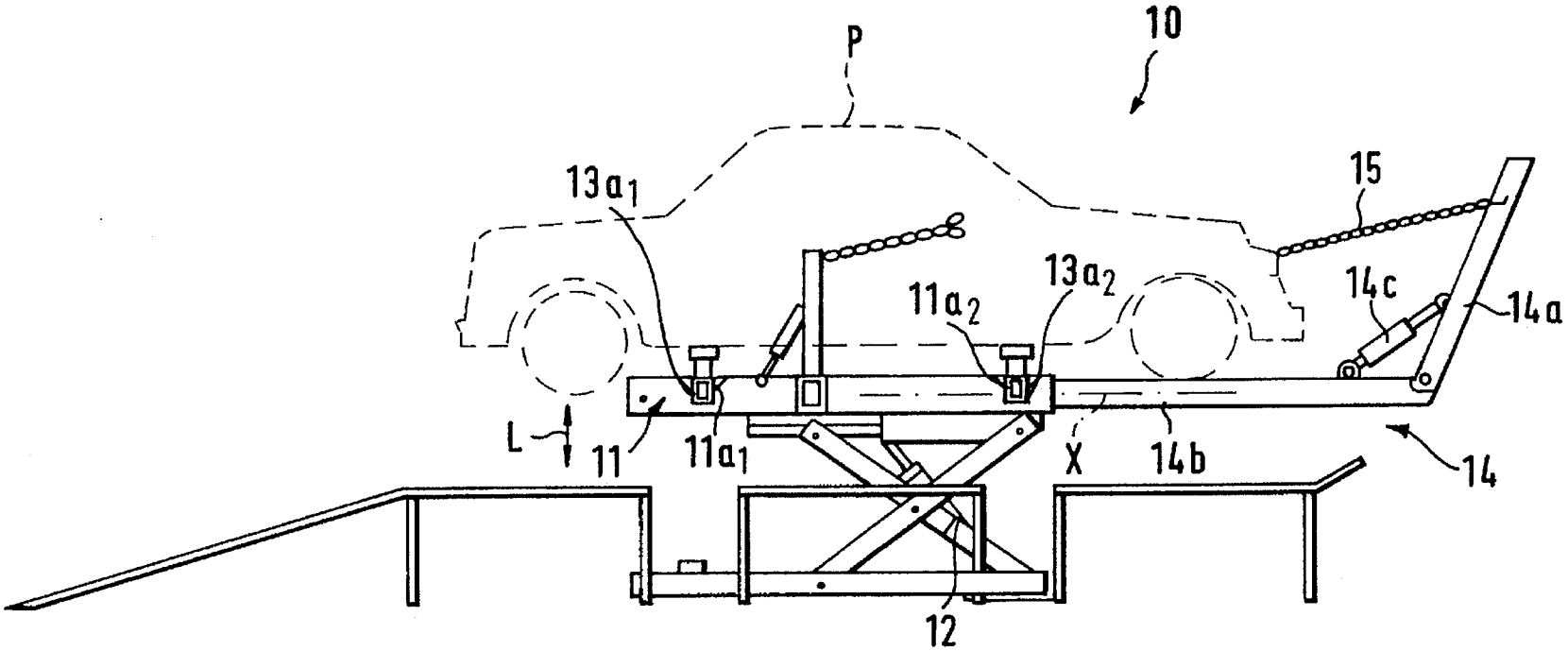
FIG. 1 is a side view of a device for alignment of an automobile body in accordance with the invention and used in a method in accordance with the invention.
Figure 2:
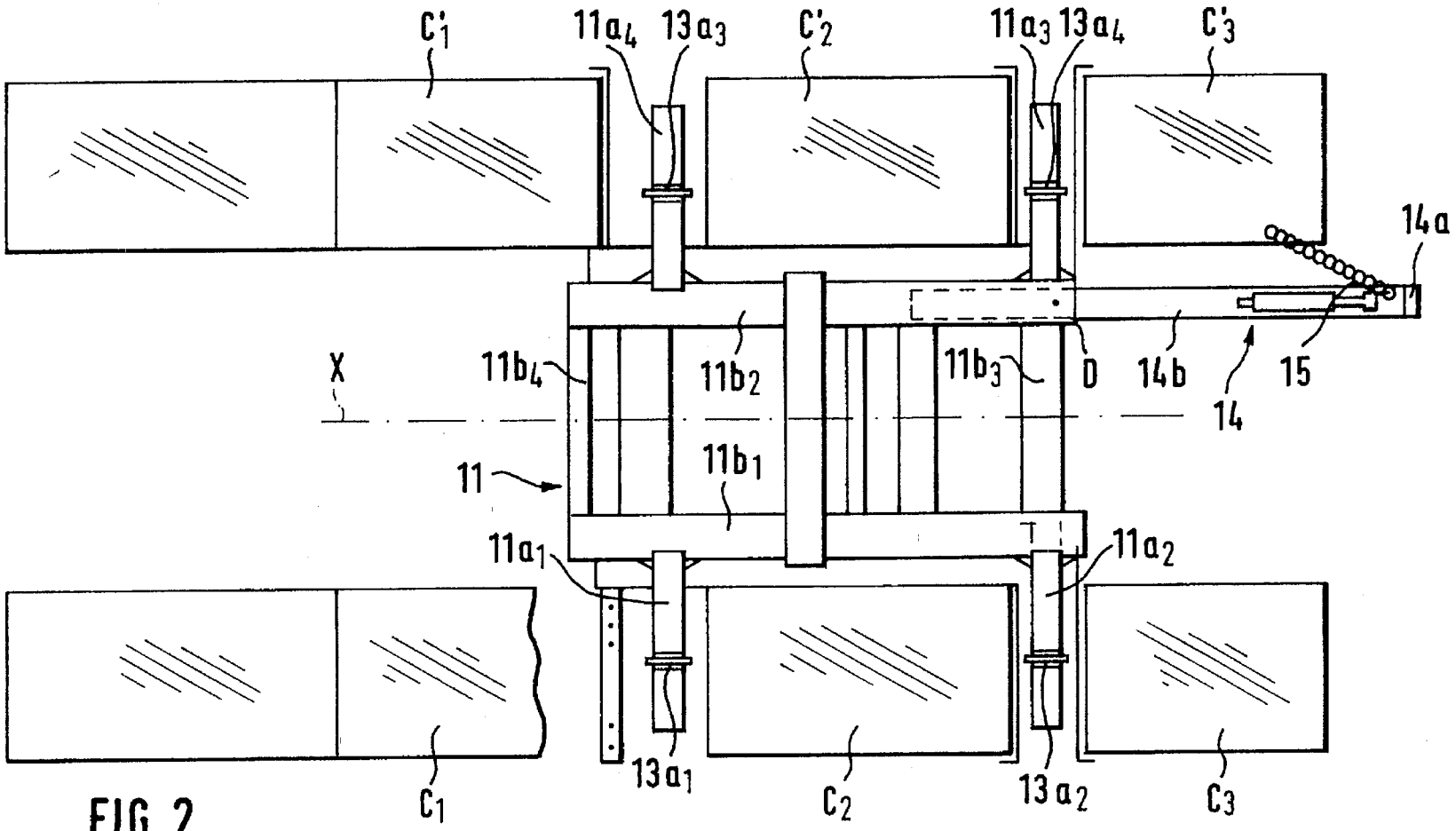
FIG. 2 shows the device for alignment of an automobile body viewed from above.

Referring to the accompanying drawings wherein the same reference numerals refer to the same or similar elements, FIG. 1 shows a device 10 in accordance with the invention for alignment of an automobile body, and which may be used in the method in accordance with the invention. The device 10 comprises an alignment table 11 having skirt fastenings or skirt clamps 13$a_1$, 13$a_2$, 13$a_3$, 13$a_4$ arranged thereon (only 13$a_1$ and 13$a_2$ are shown in FIG. 1, 13$a_3$ and 13$a_4$ being on the opposite side of the alignment table 11 as shown in FIG. 2). For use, a vehicle P is moved on to the alignment table and attached to the skirt clamps 13$a_1$, 13$a_2$, 13$a_3$, 13$a_4$. By means of a lifting device 12 associated with and ideally connected to the alignment table 11, the vehicle P on the alignment table 11 is raised to a desired repair height (the movement of the alignment table 11 and vehicle P being designated by arrow L). As shown in FIG. 1, an alignment unit 14 is connected to the alignment table 11 and comprises a tool 15, for example a pulling rope or chain. The pulling rope or chain 15 is arranged on an alignment boom 14*a* of the alignment unit 14 and can be pivoted by means of an actuator 14*c* so that the power is applied to the part of the vehicle to be aligned through the pulling rope or chain 15. Actuator 14*c* is connected at one end to the boom 14*a* and at an opposite end to a beam 14*b* in a position so that boom 14*a* is slanted relative to beam 14*b*. FIG. 1 also shows projecting elongate beams 11$a_1$ and 11$a_2$ which will be explained below.

FIG. 2 shows the device of FIG. 1 viewed from above. In operation, the vehicle is driven onto drive plates $C_1$, $C_2$, $C_3$, $C_1'$, $C_2'$, $C_3'$, in which case, when the alignment table 11 is placed in a lower position, projecting beams 11$a_1$, 11$a_2$, 11$a_3$, 11$a_4$ of the alignment table 11 are situated in spaces between the drive plates, e.g., projecting beam 11$a_1$ is situated between adjacent drive plates $C_1$ and $C_2$. As shown in FIG. 2, the skirt fastenings or skirt clamps 13$a_1$, 13$a_2$, 13$a_3$, 13$a_4$ are placed on a respective one of the projecting beams 11$a_1$, 11$a_2$, 11$a_3$ and 11$a_4$. The projecting beams 11$a_1$, 11$a_2$ . . . project from the frame rim of the alignment table 11 which comprises beams 11$b_1$ and 11$b_2$ arranged parallel to the central and longitudinal axis (X-axis) of the alignment device and connecting cross beams 11$b_3$ and 11$b_4$ arranged perpendicular to the longitudinal beams. The alignment tool 14, and specifically beam 14*b*, can be attached in the manner shown in FIG. 2 to an open end D of the beam 11$b_2$ of the alignment table 11, for example, by means of a screw or by means of other mechanical fastenings.

FIG. 3A shows one embodiment of a skirt fastening or skirt clamp 13 in accordance with the invention. Each skirt clamp 13 comprises a first body part 13$b_1$ and a second body part 13$b_2$ having a respective jaw e1 and e2 which can be shifted toward, or apart from, one another by threading a nut M on a screw R.

The screw R is coupled operationally, besides with the first body part 13$b_1$ and the second body part 13$b_2$, also with a wedge piece or part 13$b_3$ (See FIG. 3B). The first body part 13$b_1$ and the second body part 13$b_2$ include respective jaws $e_1$ and $e_2$ between which a portion of the skirt beam of the vehicle is grasped, pressed and thus supported. The second body part 13$b_2$ and the wedge part 13$b_3$ each include an aligned aperture through which a screw R attached to the first body part 13$b_1$ is passed. When a nut M is threaded on the threading on the screw R, a face F1 of the wedge part 13$b_3$ is guided along with a back-up face F2 on the body part 13$b_2$ of the skirt clamp 13, in which case the wedge part 13$b_3$ is pressed into contact with a top face 11$a_1$' of the beam 11$a_1$.

FIGS. 3B and 3C are exploded views of the parts 13$b_1$, 13$b_2$ and 13$b_3$, the skirt clamp 13 and the screw R. Around the screw R, there is a spring J which provides the opening force and brings the jaws e1 and e2 apart from one another when the skirt clamp 13 is being opened. At the pressing stage, a portion of the skirt joint $S_1$ of the vehicle (See FIG. 4A) is placed between the jaws e1 and e2, and the nut M is threaded. At the same time as the press 13 is fixed to the beam 11$a_1$ upon rotational movement of the nut M, the jaws e1 and e2 are pressed around the skirt joint $S_1$. In this manner, the vehicle is fixed to the alignment table 11. As shown in FIG. 3C, the screw R is fixed to a bushing $T_2$ which is attached to a cross-shaft $T_1$ by means of an articulated joint. The screw R is passed through a hole C in the wedge part 13$b_3$. The parts 13$a_1$, 13$a_2$ include free intermediate spaces D, D' through which the beam 11*a* is passed. A ridge O' on a lower portion of the part 13$b_2$ is arranged to be placed behind an intermediate member O of the part 13$b_1$ during cooperation between parts 13$b_1$ and 13$b_2$.

Figure 4B:
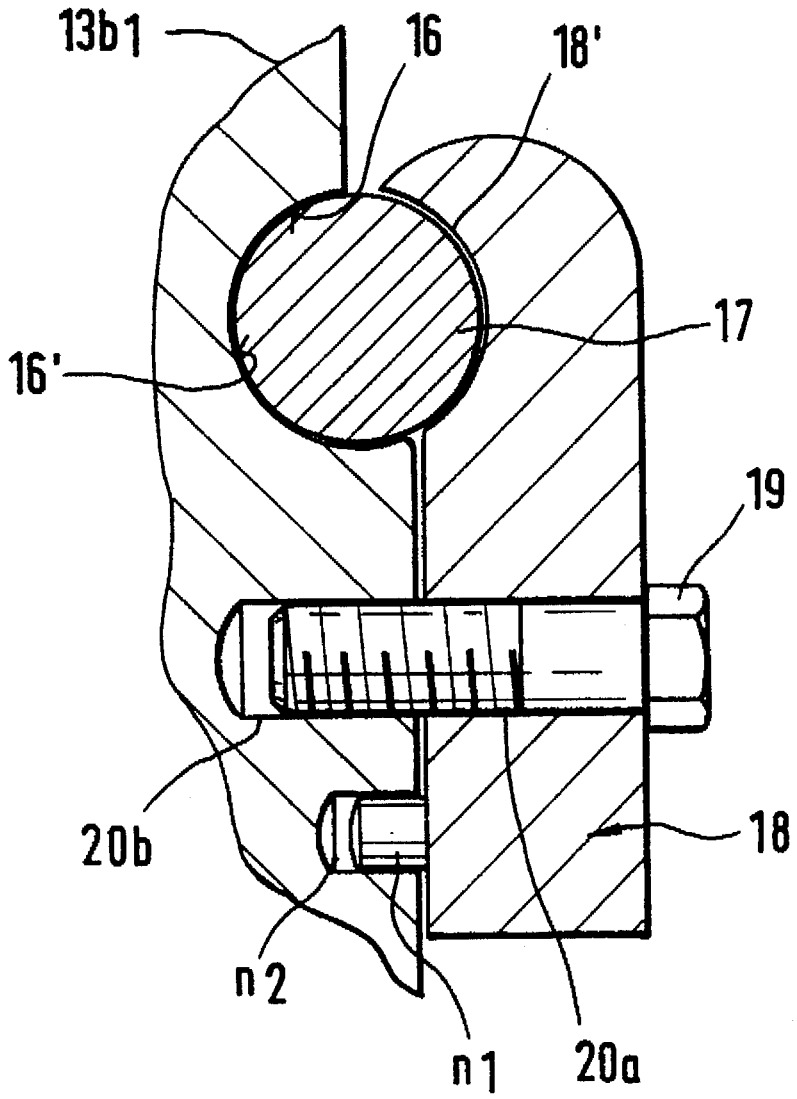
FIG. 4B is a sectional view taken along the line I—I in FIG. 4A.

FIG. 4A shows a support construction in accordance with the invention. FIG. 4B is a sectional view taken along the line I—I in FIG. 4A. The skirt clamp 13 comprises a back-up recess 16 in a side face of the body part 13$b_1$, which recess has a curved, preferably semi-circular shape against which a support arm 17 is placed. The support arm 17 preferably has a circular section, i.e., so that it corresponds to the shape of the back-up recess 16. The support arm 17 is pressed against a face 16' of the back-up recess 16 by a back-up part 18 coupled or connected to the side face of the body part $13b_1$. Back-up part 18 comprises a curved face 18' at its upper end which is placed against the outer face of the support arm 17 in a coupling situation. A fastening member, preferably a screw 19, is passed through the back-up part 18 through a hole 20*a* therein and into contact with a threaded hole 20*b* in the body part $13b_1$ to thereby couple the back-up part 18 to the body part $13b_1$. Thus, by means of the fastening member 19, the back-up part 18 can be pressed against the face 17' of the support arm 17 to securely retain the support arm 17 between the back-up part 18 and the body part $13b_1$.

The support arm 17 and preferably also the back-up part 18 have roughened faces which increase the friction of the parts in a locking situation, i.e., when the curved face 18' of the back-up part 18 is pressed against the support arm 17. Other means for increasing the friction grasp between the support arm 17 and the back-up part 18 may also be utilized.

The back-up part 18 includes guiding means such as a pin $n_1$ projecting from the side face thereof for guiding movement of the back-up part 18 against the support arm 17 in a direction toward the body part $13b_1$. The projecting pin $n_1$ is placed into a corresponding, aligning hole $n_2$ in a face of the body $13b_1$ oriented toward the back-up part 18 so that when the screw 19 is rotated, the locking part, i.e., the back-up part 18, remains in its position.

In the following, the arrangement of equipment in accordance with the invention will be described with reference to FIG. 4A. The support arm 17 is attached by means of the back-up part 18 and the fastening means, i.e., the screw 19, into a precise position on the body of the skirt clamp 13 pressing the back-up part 18 against the support arm 17, which is achieved by threading the screw 19, and by pressing it against the curved face 16' in the recess 16. Before the locking is carried out, the support arm 17 is positioned in the manner indicated by the arrow $L_1$ in the desired manner in the longitudinal direction of the beam $11a_1$. The support arm 17 can also be rotated in the way indicated by arrow $L_2$ into the desired angle in relation to the skirt clamp 13.

As shown in FIG. 4A, at one of its ends, the support arm 17 comprises a bushing part arranged perpendicular to the support arm 17, i.e. a second arm part 22. Inside the bushing part 22, there is an auxiliary bushing 23 provided with an inside or internal threading. An auxiliary bushing 23 may be attached to the bushing 22 by means of a screw 24. The inside threading $m_1$ in the auxiliary bushing 23 arranged inside the bushing 22 engages with the outside threading $m_1'$ on a screw 25 passing therethrough, and when the screw 25 is rotated by an end nut $M_2$, the screw 25 can be raised and lowered together with a disk 26 connected with it by means of an articulated joint (arrow $L_3$). Support disk 26 is arranged at an end of the screw 25 and is designed to engage with a second support region or portion of the vehicle. Thus, the bottom construction of the vehicle can be supported by the skirt fastening 13 at a location of the vehicle P bottom alongside the skirt beam H.

Figure 5A:
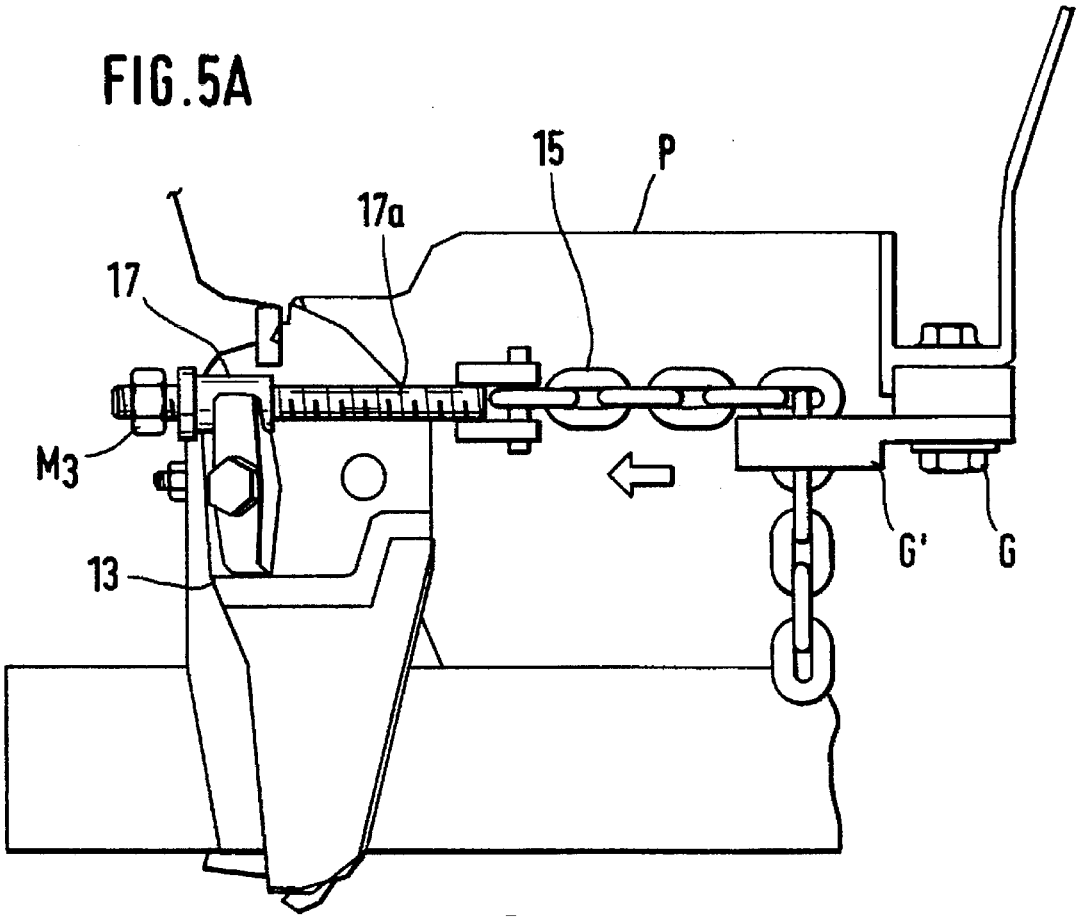
FIG. 5A shows a second embodiment of a device for alignment of an automobile body in accordance with the invention and used in a method in accordance with the invention, in which the support arm comprises a hollow bushing in relation to which the screw part can be positioned.

FIG. 5A illustrates a second mode of support, in which a bolt G is attached to the bottom of the vehicle P and moreover, a pulling chain 15 is attached to the same location to a guide G' which is coupled to the bottom of the vehicle P via the bolt G. In this embodiment, the support arm 17 is attached to the skirt clamp 13 in a manner similar to that in the embodiment of FIG. 4. Further, in this embodiment, the support arm 17 comprises an inside or interior screw 17*a* which revolves by means of a threading $m_3'$ positioned in engagement with an interior or internal threading $m_3$ in the support arm 17. Thus, the support arm 17 is in this embodiment a hollow bushing-like part into which the screw 17*a* is threaded. The screw 17*a* is locked against the support arm 17 by means of a nut $M_3$.

Figure 5B:
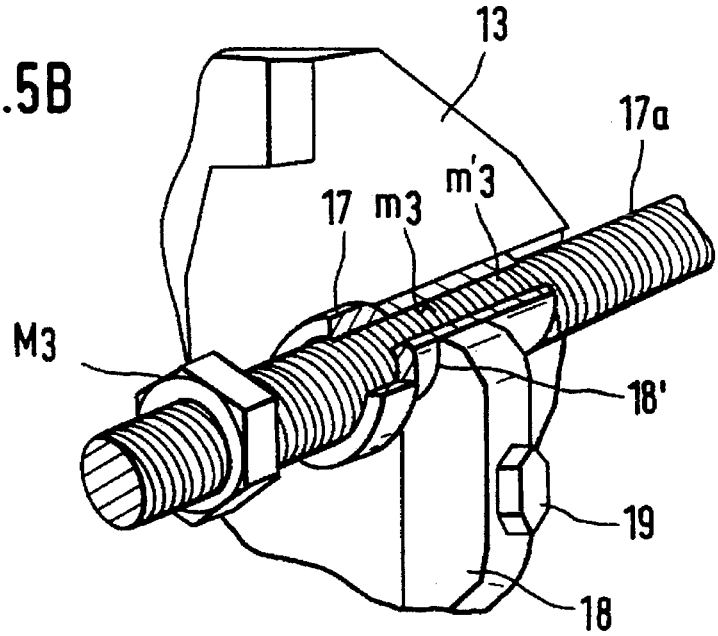
FIG. 5B is a partial sectional view of the bushing construction shown in FIG. 5A.

FIG. 5B is an axonometric view of the part 17 and a partial sectional view of FIG. 5A.

FIG. 6 illustrates a mode of support in accordance with the invention in which the suspension and the support are brought from the skirt clamp 13 through the support arm 17 to an auxiliary support arm 170 arranged substantially perpendicular to the support arm 17. The auxiliary support arm 170 comprises a threading 171 on a portion thereof. The auxiliary support arm 170 is guided through a hollow interior of a bushing 172 and is attached to the bushing 172 connected with the arm 17 by means of nuts 173 and 174 or other suitable fastening means. At the upper end of the arm 170, there is a clamp 130 which comprises jaws e1 and e2, an upper joint $S_2$ of the skirt beam H being pressed in the space between these jaws by means of the screw $R_{10}$.

Thus, in the embodiment of FIG. 6, the skirt beam H of the vehicle P is supported, besides from the lower joint $S_1$, also from the upper joint $S_2$. From the lower joint, the beam H is fixed by means of the skirt clamp 13, and from the upper joint $S_2$, the upper joint $S_2$ is pressed by means of the clamp 130, the clamp 130 being connected through the auxiliary support arm 170 with the support arm 17 and further, through the support arm 17, detachably by means of fastening means 16, 18, 19 with the clamp 13. In this illustrated embodiment, the arrows denote the various directions of adjustment of the suspension. Moreover, a second support of the vehicle P bottom may be carried out by means of the support arrangement shown in FIG. 4.

FIG. 7 shows the clamp of FIG. 6 viewed in the direction of the arrow $k_1$ in FIG. 6. From the drawing, it is seen that the clamp comprises back-up recesses 16 having a semicircular section shape for the support arm 17 at both sides. Thus, the construction is symmetric in relation to the vertical plane of the skirt clamp and may comprise suspension means and support arms 17 at both sides, as is also shown in FIG. 6.

The examples provided above are not meant to be exclusive. Many other variations of the present invention would be obvious to those skilled in the art, and are contemplated to be within the scope of the appended claims.

I claim:

1. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, a support arm, fastening means for detachably connecting said support arm to said first body part of at least one of said skirt clamps such that said support arm is movable relative to said at least one of said skirt clamps, and coupling means for coupling said support arm to a second support region of the vehicle.

wherein said fastening means comprise a back-up recess arranged in said first body part, a back-up part having a recess arranged in connection with or in the direct vicinity of said back-up recess in said first body part, and pressing means for pressing said back-up part against said support arm while said support arm is in a position between said back-up recess in said first body part and said recess of said back-up part.

2. The device of claim 1, wherein said back-up recess in said first body part and said recess of said back-up part have a shape corresponding to the shape of said support arm, said back-up recess in said first body part and said recess of said back-up part being curved.

3. The device of claim 1, wherein said pressing means comprise a screw threaded through an aperture in said back-up part and an aligned aperture in said first body part.

4. The device of claim 1, further comprising guiding means for guiding movement of said back-up part against said support arm toward said first body part, said guiding means comprising a projecting pin arranged on a face of said back-up part oriented toward said first body part and a corresponding aperture in a face of said first body part oriented toward said back-up part.

5. The device of claim 1, further comprising means for increasing the friction grasp between said support arm and said back-up part, said friction grasp increasing means comprising a roughening on peripheral areas of said support arm and/or a roughening on a face of said back-up part oriented against said support arm.

6. The device of claim 1, wherein said support arm is elongate and comprises a bushing at one end thereof, said bushing having an internal threading, said coupling means comprising a rotatable screw threaded into said internal threading of said bushing such that said screw is positionable in different positions relative to said bushing upon rotation thereof.

7. The device of claim 1, wherein said support arm is elongate, said coupling means comprising a hollow bushing arranged at one end of said support arm, an auxiliary bushing arranged in and fixedly coupled to said hollow bushing, said auxiliary bushing having an internal threading, and a rotatable screw threaded into said internal threading of said auxiliary bushing such that said screw is positionable in different positions relative to said auxiliary bushing and said hollow bushing upon rotation thereof.

8. The device of claim 6, wherein said screw is elongate, said coupling means further comprising a support disk arranged at an end of said screw, said support disk engaging with said second support region of the vehicle.

9. The device of claim 1, wherein said support arm comprises a member detachably coupled to said first body part, said member having a hollow interior and an internal threading, a rotatable screw arranged in said hollow interior of said member in engagement with said internal threading, said screw being movable upon rotation thereof relative to said member, and locking means for locking said screw in a fixed position relative to said member, said locking means comprising a nut.

10. The device of claim 1, wherein said support arm is elongate, said coupling means comprising an elongate bushing arranged at an end of said support arm, said bushing having a hollow interior and a nut arranged at each end thereof, an auxiliary support arm coupled to and movable relative to said support arm, said auxiliary support arm comprising a threading engaging with said nuts and passing through said bushing such that said auxiliary support arm is movable relative to said support arm upon rotation of said threading of said auxiliary support arm relative to said bushing and said nuts, said auxiliary support arm comprising a clamp having jaws for engaging with said second support region of the vehicle.

11. The device of claim 10, wherein the skirt beams of the vehicles having a lower joint and an upper joint, said at least one of said skirt clamps grasping the lower joint of the support skirt beam and said second support region of the vehicle being the upper joint of the support skirt beam.

12. The device of claim 1, wherein said displacement means comprise an actuating screw connected to said first body part and a nut threaded thereto, each of said skirt clamps further comprising a third wedge part, said second body part and said third wedge part having an aligned aperture, said screw passing through said apertures in said second body part and said third wedge part and said nut being threaded onto said screw after said screw has passed through said apertures.

13. The device of claim 9, wherein said coupling means comprise a chain connected at an end thereof to said rotatable screw, a guide to which said chain is attached, and fixing means for fixedly connecting said guide to said second support region of the vehicle.

14. A method for supporting a vehicle body during alignment of the vehicle body on an alignment table, wherein the vehicle has skirt beams each having a lower joint and an upper joint, comprising the steps of:

grasping the lower joint of a skirt beam by means of first skirt clamps of respective skirt fastenings coupled to the alignment table, movably mounting a first end of an elongate support arm in connection with each of the skirt fastenings, mounting a second skirt clamp to a second end of each of the support arms such that each of the second skirt clamps, is coupled to a respective one of the first skirt clamps and grasping the upper joint of the skirt beam by means of the second skirt clamps by adjusting the position of the support arms with respect to a respective one of the skirt fastenings until the respective second skirt clamp engages and is clampable to the upper joint of the skirt beam.

15. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, an elongate support arm comprising a bushing at one end thereof, said bushing having an internal threading, fastening means for detachably connecting said support arm to said first body part of at least one of said skirt clamps such that said support arm is movable relative to said at least one of said skirt clamps, and coupling means for coupling said support arm to a second support region of the vehicle, said coupling means comprising a rotatable screw threaded into said internal threading of said bushing such that said screw is positionable in different positions relative to said bushing upon rotation thereof.

16. The device of claim 15, wherein said screw is elongate, said coupling means further comprising a support disk arranged at an end of said screw, said support disk engaging with said second support region of the vehicle.

17. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, an elongate support arm, fastening means for detachably connecting said support arm to said first body part of at least one of said skirt clamps such that said support arm is movable relative to said at least one of said skirt clamps, and coupling means for coupling said support arm to a second support region of the vehicle, said coupling means comprising a hollow bushing arranged at one end of said support arm, an auxiliary bushing arranged in and fixedly coupled to said hollow bushing, said auxiliary bushing having an internal threading, and a rotatable screw threaded into said internal threading of said auxiliary bushing such that said screw is positionable in different positions relative to said auxiliary bushing and said hollow bushing upon rotation thereof.

18. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, an elongate support arm, fastening means for detachably connecting said support arm to said first body part of at least one of said skirt clamps such that said support arm is movable relative to said at least one of said skirt clamps, and coupling means for coupling said support arm to a second support region of the vehicle, said coupling means comprising an elongate bushing arranged at an end of said support arm, said bushing having a hollow interior and a nut arranged at each end thereof, and an auxiliary support arm coupled to and movable relative to said support arm, said auxiliary support arm comprising a threading engaging with said nuts and passing through said bushing such that said auxiliary support arm is movable relative to said support arm upon rotation of said threading of said auxiliary support arm relative to said bushing and said nuts, said auxiliary support arm comprising a clamp having jaws for engaging with said second support region of the vehicle.

19. The device of claim 18, wherein the skirt beams of the vehicles having a lower joint and an upper joint, said at least one of said skirt clamps grasping the lower joint of the support skirt beam and said second support region of the vehicle being the upper joint of the support skirt beam.

20. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, said displacement means comprising an actuating screw connected to said first body part and a nut threaded thereto, each of said skirt clamps further comprising a third wedge part, said second body part and said third wedge part having an aligned aperture, said screw passing through said apertures in said second body part and said third wedge part and said nut being threaded onto said screw after said screw has passed through said apertures, a support arm, fastening means for detachably connecting said support arm to said first body part of at least one of said skirt clamps such that said support arm is movable relative to said at least one of said skirt clamps, and coupling means for coupling said support arm to a second support region of the vehicle.

21. A device for alignment of a vehicle having skirt beams, comprising an alignment table, skirt clamps arranged on said alignment table for attaching the skirt beams of the vehicle to said alignment table, each of said skirt clamps comprising a first body part having a first jaw and a second body part having a second jaw, and displacement means for moving said first and second jaws relative to one another to grasp a first support skirt beam of the vehicle, a support arm including a member detachably coupled to said first body part and having a hollow interior and an internal threading, a rotatable screw arranged in said hollow interior of said member in engagement with said internal threading, said screw being movable upon rotation thereof relative to said member, and locking means for locking said screw in a fixed position relative to said member, said locking means comprising a nut, fastening means for detachably connecting said support arm to said first body part of at least one of said skirt clamps such that said support arm is movable relative to said at least one of said skirt clamps, and coupling means for coupling said support arm to a second support region of the vehicle, said coupling means comprising a chain connected at an end thereof to said rotatable screw of said support arm, a guide to which said chain is attached, and fixing means for fixedly connecting said guide to said second support region of the vehicle.

* * * * *